United States Patent [19]

Van Tiel

[11] Patent Number: 4,870,330

[45] Date of Patent: Sep. 26, 1989

[54] CATHODE-RAY TUBE WITH DEFLECTION SYSTEM

[75] Inventor: Antonius H. Van Tiel, Eindhoven, Netherlands

[73] Assignee: U.S. Philips Corporation, New York, N.Y.

[21] Appl. No.: 254,913

[22] Filed: Oct. 6, 1988

[30] Foreign Application Priority Data

Oct. 20, 1987 [NL] Netherlands ..... 8702500

[51] Int. Cl.[4] ..... H01J 29/56

[52] U.S. Cl. ..... 315/370; 335/213; 313/413

[58] Field of Search ..... 315/370; 335/213; 313/413

[56] References Cited

U.S. PATENT DOCUMENTS 3,898,520 8/1975 Gerritsen et al. ..... 315/370

4,232,253 11/1980 Mortelmans ..... 335/213

*Primary Examiner*—Theodore M. Blum

*Attorney, Agent, or Firm*—Michael E. Marion

[57] ABSTRACT

A cathode-ray tube and deflection system suitable for a cathode-ray tube.

A cathode-ray tube having a deflection system, comprising two switched line deflection coils, a coil being arranged between the deflection coils, and a line deflection system suitable for a cathode-ray tube. The coil reduces the occurrence of "ringing" on the picture screen without necessitating a modification in the design of the deflection system or the enivonment of the deflection system.

4 Claims, 2 Drawing Sheets

CATHODE-RAY TUBE WITH DEFLECTION SYSTEM

BACKGROUND OF THE INVENTION

The invention relates to cathode-ray tube comprising a system for generating an electron beam and a deflection system for deflecting the electron beam, which includes a picture and a line deflection system, the line deflection system having two line deflection coils arranged in parallel by means of a first and a second coupling, the first and second couplings being coupled to a first and a second energizing terminal for the supply of a line deflection voltage.

Cathode-ray tubes of this type can be used in black-white, colour and projection television tubes, in data reproducing equipment and in other equipment in which a cathode-ray tube is used.

Such a cathode-ray tube is disclosed in the U.S. Pat. No. 4,431,940.

One feature which is important for the quality of the picture display is the extent to which the what is commonly referred to as "ringing" phenomenon occurs. This phenomenon occurs immediately after the line retrace and can show as a striped pattern at that edge of the picture screen where the line scan of the picture screen starts. A possible solution of this problem can be achieved by allowing the picture screen to be overscanned. This solution does not reduce the phenomenon, but the consequences of this phenomenon are not visible on the screen. This solution has however the disadvantage that the speed at which the information is displayed on the picture screen must be reduced, as the electron beam does not impinge on the visible portion of the picture screen during a part of the time. It is also necessary for the electron beam to be deflected through a wider angle, for which more energy must be applied to the deflection coil system. An alternative solution of this problem is to reduce capacitive couplings between the line deflection coils and the environment to the best possible extent. Ringing can also be caused by capacitive coupling between the line deflection coils of the line deflection system and the environment. The line deflection system and the environment form a LC circuit which is caused to resonate in response to potential differences which suddenly occur during the line retrace. Inherent to such a solution is however that the line deflection coils and/or the environment must be modified therefor. It is therefore an object of the invention to reduce "ringing∞ for a cathode-ray tube of the type defined in the opening paragraph without a modification of the design of the line deflection system and/or the environment being required.

SUMMARY OF THE INVENTION

A cathode-ray tube according to the invention is therefore characterized in that the couplings include a coil having two sub-coils wound around a core with the same winding sense, one sub-coil forming part of the first coupling and the other sub-coil forming part of the second coupling.

The coil has the two sub-coils wound with the same winding sense, so that the inductance L coil of the coil is small and thus has little influence on the total L of the line deflection system and consequently no or only a slight influence on the deflection, and has a frequency-dependent energy loss factor. For frequencies higher than the line frequency this energy loss factor increases.

As a result thereof, oscillations in the line deflection system having a frequency higher than the line frequency are damped to a greater extent than lower frequencies. This results in a decrease in "ringing". This is applicable to any existing cathode-ray tube without the necessity of modifying the design of the cathode-ray tube, except for the addition of the coil.

An embodiment of a cathode-ray tube according to the invention for which the capacitive coupling between one of the line deflection coils and the environment is greater than between the other line deflection coil and the environment, is characterized in that the energizing terminals are coupled to the other line deflection coil and the coil.

For such a cathode-ray tube in which the capacitive coupling between one of the line deflection coils and the environment is greater than between the other line deflection coil and the environment "ringing" will mainly occur in that line deflection coil which couples to the environment with the highest possible capacitive degree. By coupling the energizing terminals to the other line deflection coil and the coil, the coil is coupled strongest to that deflection coil where "ringing" occurs.

The invention also relates to a deflection system for a cathode-ray tube, provided with the above-described anti-ringing means.

BRIEF DESCRIPTION OF THE DRAWINGS

Some embodiments of a cathode-ray tube according to the invention will now be described in greater detail by way of example with reference to the accompanying drawings. Herein.

DETAILED DESCRIPTION OF THE PREFERRED EMBODIMENT

Figure 1:
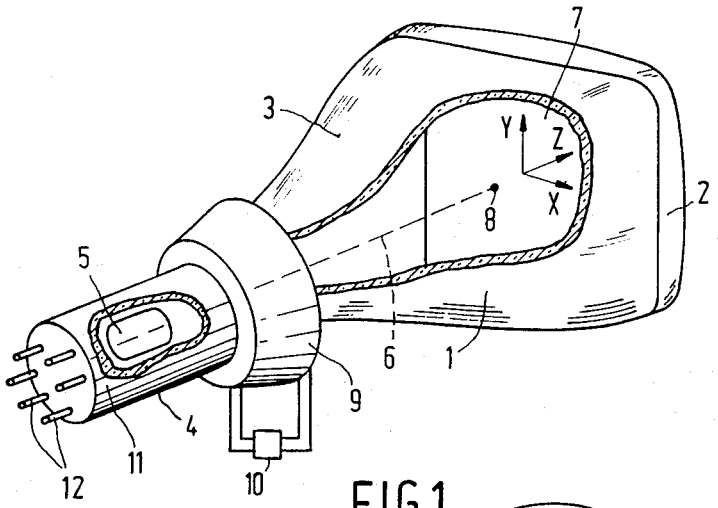
FIG. 1 shows a a cathode-ray tube according to the invention in a partly cut-away perspective view.

The Figures are are schematic and not drawn to scale, corresponding components in the different Figures having been given as a rule the same reference numerals.

FIG. 1 shows a partly cut-away perspective view of a cathode-ray tube according to the invention, in this case of a 110° black-white monitor. The invention can also be used for colour monitor tubes, camera tubes and colour picture tubes. The tube shown comprises a glass envelope 1, formed by a face plate 2, a cone 3 and a neck 4, an electron gun 5 for generating an electron beam 6 being provided in this neck 4. This electron beam 6 is focused onto a picture screen 7 to form a target 8. The picture screen 7 is provided on the interior side of the face plate 2. The electron beam 6 is deflected across the picture screen 7 in two mutually perpendicular directions x,y by means of a deflection coil system 9, with coil 10. The tube has a base 11 with pins 12.

Figure 2:
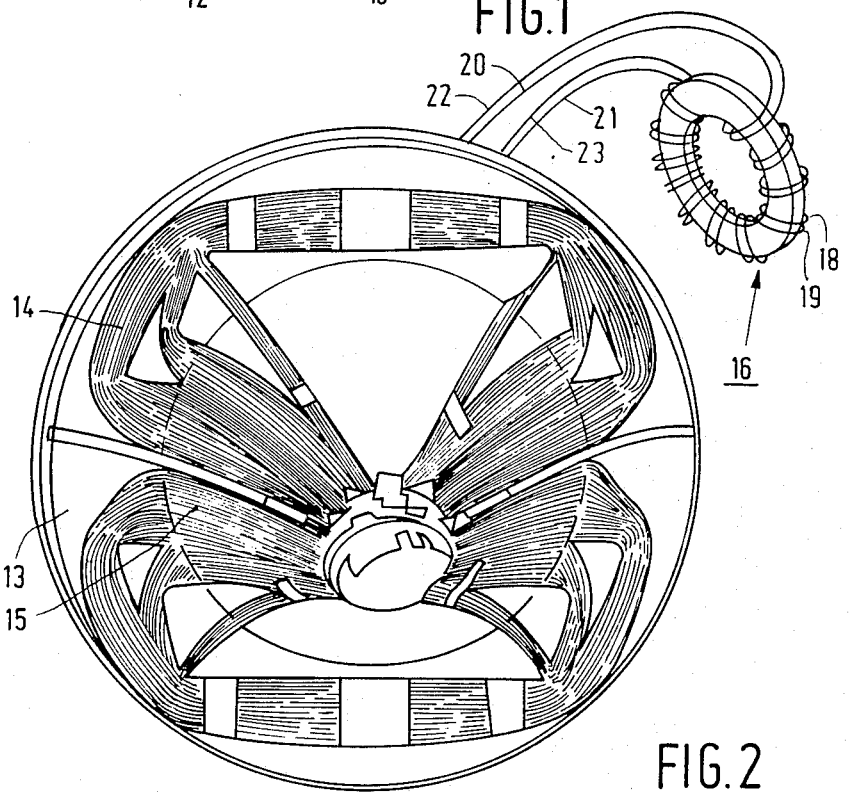
FIG. 2 is a perspective view of a line deflection system suitable for a cathode-ray tube according to the invention.

FIG. 2 is a perspective view of a deflection system suitable for a cathode-ray tube according to the invention. In this embodiment the deflection system includes a cover 13 which is provided at its interior side with line deflection coils 14 and 15, the exterior side is provided with a ring core, not shown, of magnetizable material within or around which two picture deflection coils, also not shown, have been arranged. The line deflection coils provided at the interior side of the cover couple capacitively with the environment, particularly the capacitive coupling with the envelope of the cathode-ray tube being important. In addition, a coil 16 comprising two sub-coils 18 and 19 which are wound with the same winding sense around a core 17 and have connecting wires 20, 21 and 22,23, respectively, is provided on the exterior side of the cover.

Figure 3A:
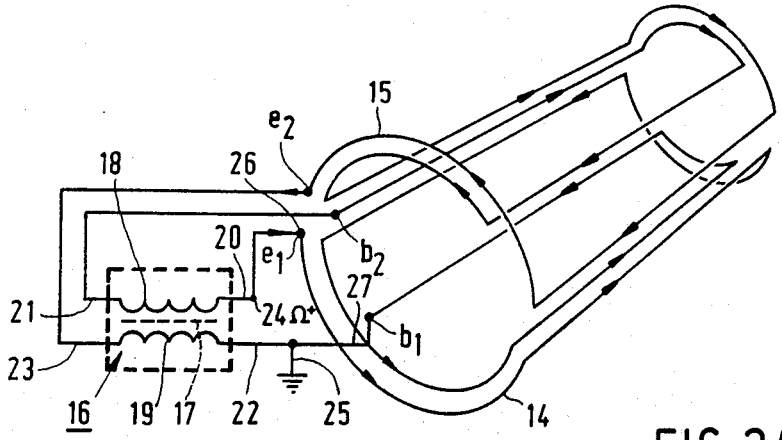
FIG. 3A shows a winding diagram for the line deflection system according to the invention and FIG. 3B shows the associated connection diagram.
Figure 3B:
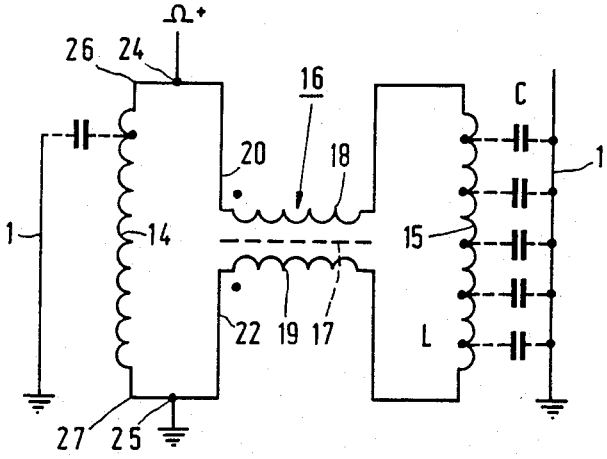

FIG. 3A shows the winding scheme for the line deflection system shown. In these Figures the points e1 and b2 are at a high voltage and the points b1 and e2 are at a low voltage (b1 is at ground in this case). The letters e and b indicate the beginning and the end, respectively, of the deflection coils. Consequently, of line deflection coil 14 the innermost portions of the coil and consequently the portions nearest to the envelope are generally at a lower potential than corresponding portions of line deflection coil 15. The capacitive coupling of both coils with the envelope are therefore not identical, but are greater for line deflection coil 15 than for line deflection coil 14. The energizing terminals 24 and 25 are connected, in a preferred embodiment of the invention, between the terminals 26 and 27 of line deflection coil 14 and terminals 20 and 22 of coil 16. FIG. 3B shows the connection diagram of the line deflection system. Line deflection 15 is coupled more capacitively to the envelope than line deflection coil 14. The coil 16 is arranged between this line deflection coil 15 and energizing terminals 24 and 25. In this embodiment the coil comprises two sub-coils 18 and 19 which are wound with the same winding sense and consist of a small number of turns of twisted wire, and are wound on a ferrite core having a high magnetic permeability coefficient $\mu$ and considerable energy losses at frequencies higher than the line frequencies. In this example the coil 16 has a torroidal ring core 17 made of the 3 Hz ferrite type with an outside diameter of 23 mm, an inside diameter of 13 mm and a height of 7 mm and a magnetic permeability coefficient between approximately 2300 and 3100. The deflection system is in this example an AT1039-deflection system. The inductance L of line deflection coil 15 and the parasitic capacitance C between this deflection coil 16 and the environment, the largest contribution coming from the envelope, form an LC circuit. Resonances having frequencies higher than then the line frequency are introduced in this circuit by the suddenly occurring changes in potential on this LC circuit during line retrace. At these high frequencies the resistance of the coil 16 is considerable, so that these resonances are damped. At lower frequencies the influence of the coil 16 can however be disregarded, the resistance is small with respect to the resistance of the line deflection coil 15 and the total inductance of coil 16 L′ is also small with respect to the inductance L of line deflection coil 15, so that for frequencies less than or approximately equal to the line frequency the coil 16 has no or only a negligible influence on the operation of the deflection system. The invention is not limited to the form shown here for the coil core, the core shown, the type of ferrite of the deflection system type. The core of the coil may, for example, alternatively be in the shape of a rod or a pot, many different shapes for a magnetic core are known. The energy loss factor of magnetic cores increases versus increasing frequencies. The line frequency for a cathode-ray tube depends to some small degree on the type of cathode-ray tube, and is of the order of magnitude from 10 to 100 kHz. "Ringing" phenomena have typical frequencies of the order of 1 to 10 Mhz, it generally being such that the higher the line frequencies also the typical "ringing" frequencies will be higher, namely one to two orders higher. The coil is preferably designed such that a large difference in energy loss factor between the line frequency and the typical "ringing" frequencies occurs. The core may, for example, be of a material which evidences a large difference in energy loss due to eddy currents and/or due to hysteresis losses for these two frequencies. Energy loss factor must here be understood to mean the fractional energy loss per cycle.

Figure 4A:
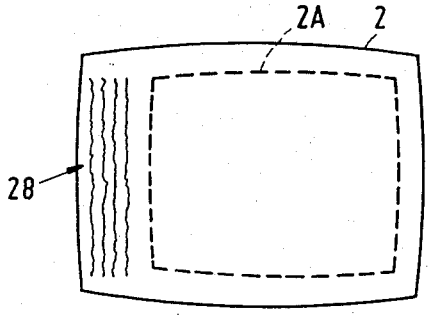
FIGS. 4A and 4B show schematically the effect of "ringing" on the picture tube and the result achieved by the invention.

FIG. 4 shows a picture screen 2 on which the effect of "ringing" is shown schematically by stripes 28. These stripes are produced at that side of the picture screen where the line scan of the picture screen starts. This annoying effect can be rendered invisible by displaying only the portion 2*a* of the picture screen located within the broken lines, i.e. by applying "overscan". This has however the drawback that the speed at which the information is displayed on the picture screen is to be reduced, since the electron beam impinges during part of the time on the invisible part of the picture screen. In addition, the electron beam must be deflected through a wider angle and consequently more energy must be supplied to the deflection coil system.

Figure 4B:
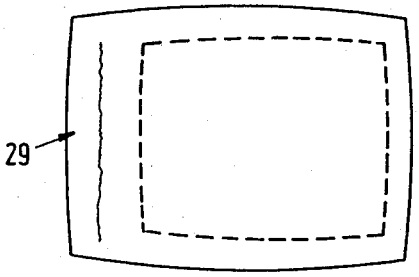

FIG. 4B shows a picture screen of a cathode-ray tube according to the invention. Only one stripe is now however visible. This renders it possible to use a larger portion of the picture screen for useful information.

It will be obvious that many variations are possible for a person skilled in the art, within the scope of the invention.

What is claimed is:

1. A cathode-ray tube comprising a system for generating an electron beam and a deflection system for deflecting the electron beam, which includes a picture and line deflection system, the line deflection system having first and second line deflection coils arranged in parallel by means of a first and a second coupling, the first and second couplings being coupled to a first and a second energizing terminal for the supply of a line deflection voltage, characterized in that said first and second couplings include a coil having first and second sub-coils wound around a core with the same winding sense, said first sub-coil forming a part of said first coupling and said second sub-coil forming part of said second coupling.

2. A cathode-ray tube as claimed in claim 1, wherein said first and second line deflection coils are capacitively coupled to an environment and for which the capacitive coupling between said first line deflection coil and the environment exceeds the coupling between said second line deflection coil and the environment, characterized in that the energizing terminals are coupled to said second line deflection coil and said coil.

3. A deflection system for a cathode-ray tube comprising a picture and line deflection system, the line deflection system comprising two line deflection coils which are arranged in parallel by means of a first and a second coupling to respective first and second energizing terminals for applying a line deflection voltage, characterized in that the couplings include a coil comprising two sub-coils which are wound on a core with the same winding sense, a first sub-coil being associated with the first coupling and a second sub-coil with the second coupling.

4. A deflection system as claimed in claim 3, characterized in that the energizing terminals are connected to said second deflection coil and said coil.

* * * * *